US005530977A

United States Patent [19]

Wang

[11] Patent Number: 5,530,977

[45] Date of Patent: Jul. 2, 1996

[54] CONTROL DEVICE FOR FOLDING AND EXPANDING ARMRAIL OF A PLAYPEN

[76] Inventor: Kun Wang, No. 51, Lane 31, Sec. 2, Changping Rd., Taichung, Taiwan

[21] Appl. No.: 296,030

[22] Filed: Aug. 25, 1994

[51] Int. Cl.[6] ..... A47D 13/06

[52] U.S. Cl. ..... 5/99.1; 16/326

[58] Field of Search ..... 5/93.1, 98.1, 99.1; 16/325, 362

[56] References Cited

U.S. PATENT DOCUMENTS

| | | | |
|---|---|---|---|
| 4,837,875 | 6/1989 | Shamie | 5/99.1 |
| 5,293,656 | 3/1994 | Chan | 5/99.1 |
| 5,353,451 | 10/1994 | Hsiung | 5/99.1 |
| 5,358,220 | 10/1994 | Yu-Kuang | 5/99.1 |

*Primary Examiner*—Flemming Saether

*Attorney, Agent, or Firm*—Ross, Clapp, Korn & Montgomery

[57] ABSTRACT

A control device is provided for folding and expanding armrails of a playpen and includes a socket member having two distal ends each pivotably engaged with a corresponding one of the armrails, a coupling member received in each of the armrails and comprising a biasing member detachably engaged with a corresponding distal end of the socket member, whereby, when the biasing member urges against associated distal end of the socket member, the armrail is fixed to the socket member, and when the biasing member is detached from the distal end of the socket member, the armrail is pivotally engaged with the socket member.

3 Claims, 5 Drawing Sheets

CONTROL DEVICE FOR FOLDING AND EXPANDING ARMRAIL OF A PLAYPEN

BACKGROUND OF THE INVENTION

1. Field of Invention

The present invention relates to a control device, and more particularly to a control device for folding and expanding armrails of a playpen.

2. Related Prior Art

The armrails device is important to the playpen for protecting the infant from falling out of the playpen and for convenience in use. A conventional control device for folding and expanding the armrails of a playpen is complex in structure and is not easy to perform the operation of folding and expanding the playpen.

The present invention has arisen to mitigate and/or obviate the above-mentioned disadvantages of the conventional control device for a playpen.

SUMMARY OF THE INVENTION

The primary objective of the present invention is to provide a control device for folding and expanding armrails of a playpen.

Another objective is to provide a control device which makes it easy to fold and expand the playpen.

In accordance with one aspect of the present invention, there is provided a control device for folding and expanding armrails of a playpen which comprises four pairs of armrails respectively arranged on four upper sides thereof, the control device co-operating with each pair of armrails and comprising a socket means having two distal ends each pivotably engaged with a corresponding one of the armrails, a coupling means received in each of the armrails and comprising a biasing member detachably engaged with a corresponding distal end of the socket means, whereby, when the biasing member of the coupling means urges against associated distal end of the socket means, the armrail is fixed to the socket means, and when the biasing member is detached from the distal end of the socket means, the armrail is pivotally moveable with the socket means.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENTS

Figure 1:
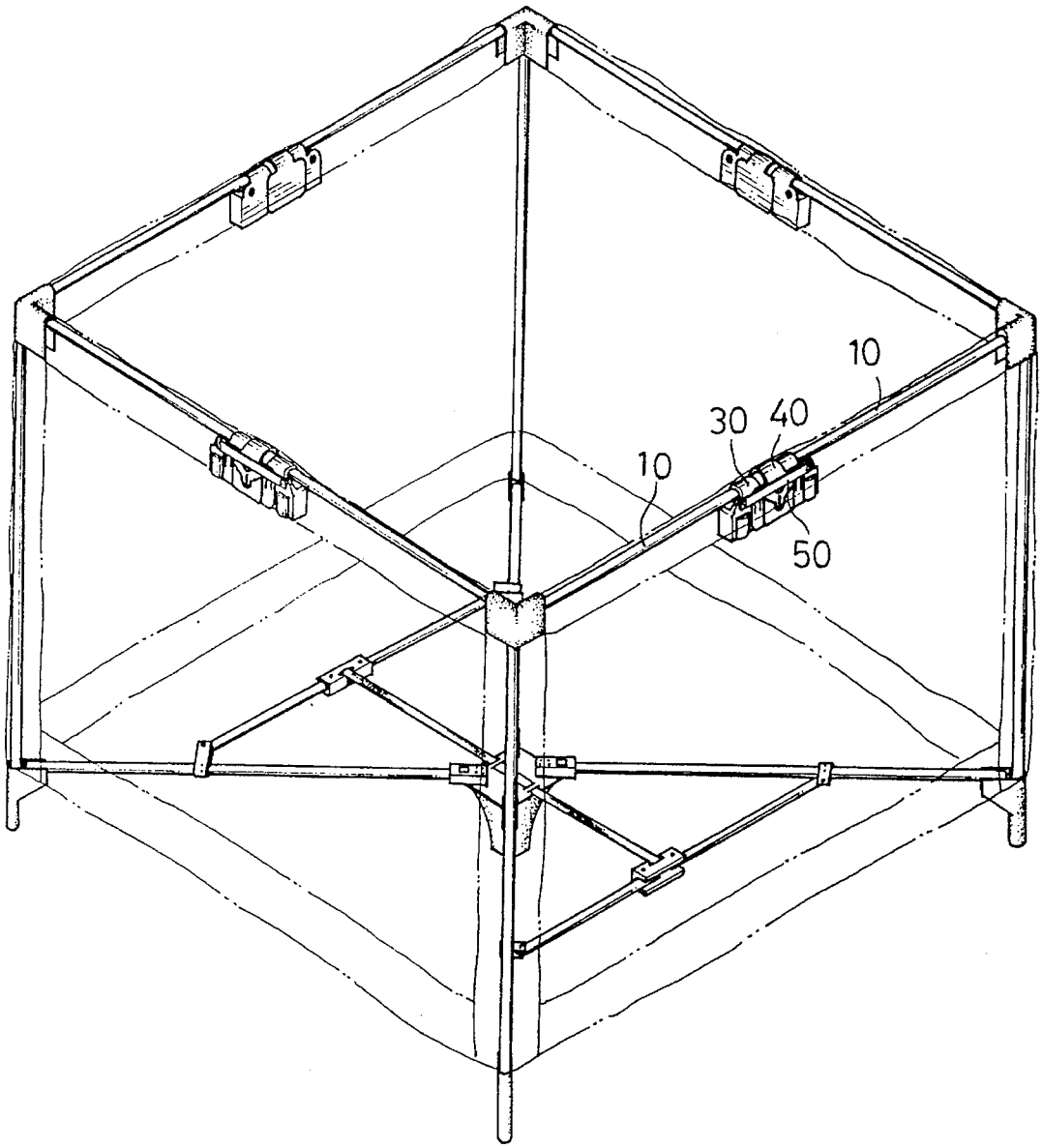
FIG. 1 is a perspective view of a control device in accordance with the present invention for folding and expanding a playpen.
Figure 2:
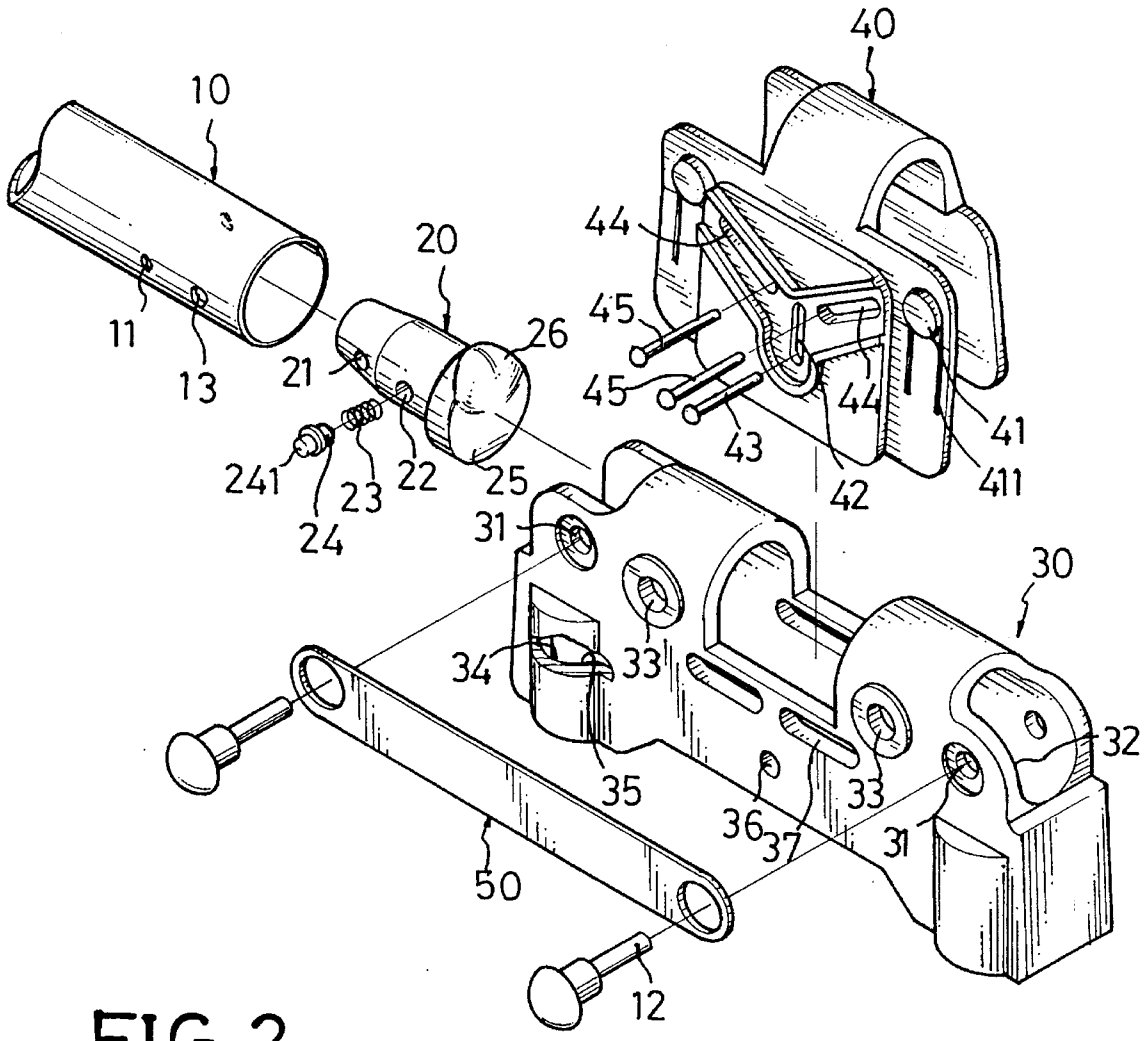
FIG. 2 is an exploded view of the control device as shown in FIG. 1.

Referring to the drawings, and initially to FIGS. 1 and 2, a control device in accordance with the present invention is provided for folding and expanding armrails of a playpen comprising four pairs of armrails 10 respectively arranged on four upper sides thereof and co-operates with each pair of armrails 10 and comprises a socket means 30 having two distal ends each pivotably engaged with a corresponding one of the pair of armrails 10, and a coupling means 20 received in each of the armrails 10 and comprising a biasing member detachably engaged with a corresponding distal end of the socket means 30. Each of the armrails 10 has a pair of first bores 11 transversely defined therethrough which are in alignment with each other, a second bore 21 is transversely defined through the coupling means 20 and aligned with the pair of first bores 11, a pair of third bores 31 is transversely defined through each of the distal ends of the socket means 30 and aligned with the pair of first bores 11 of the armrail 10, a pin 12 extends through the third bores 31, the first bores 11 and the second bore 21 such that the armrail 10 together with the coupling means 20 is pivotally engaged with a corresponding distal end of the socket means 30 and the coupling means 20 is able to rotate with the armrail 10 about the pin 12.

The socket means 30 is substantially U-shaped in section with two parallel side plates, a two distal ends and a longitudinal passage 32 defined therein, a first hole 33 defined in each of the distal ends on one side of the socket means 30, the armrail 10 defining a second hole 13 in alignment with a corresponding first hole 33 of the socket means 30, the coupling means 20 defining a compartment 22 therein, the biasing member comprising a spring 23 mounted in the compartment 22 and a stub 24 which is biased against the spring 23 and has a projection 241 extending through the second hole 13 of the armrail 10 and projecting outward of the first hole 33 of the socket means 30 so as to fix the armrail 10 to associated distal end of the socket means 30, whereby, when the projection 241 of the stub 24 is pressed inwardly to be detached from the distal end of the socket means 30, the armrail 10 together with the coupling means 20 is released from the distal end of the socket means 30 and is pivotally movable with the socket means 30 such that the coupling means 20 is able to rotate with the armrail 10 about the pin 12. A space 34 is defined in an inner wall of each of the two distal ends on one side plate of the socket means 30 and a guiding groove 35 is defined in the inner wall of each of the two distal ends of the one side plate of the socket means 30 and communicates between the space 34 and one of the corresponding first holes 33 for guiding the stub 24 of the coupling means 20 from the associated first hole 33 to be received in the space 34 when the coupling means 20 is rotated with the armrail 10 about the pin 12.

Two horizontal slots 37 adjacent to each other and an orifice 36 are defined in a mediate portion on each of the two side plates of the socket means 30, the coupling means 20 further comprising a shoulder 25 which is received in the passage 32 of the socket means 30 and is located above one of the corresponding horizontal slots 37 thereof and has a tapered surface 26, the control device further comprising a bracket means 40 which is substantially U-shaped in section with two parallel side plates for covering the socket means 30, a vertical slot 42 defined in each of the two side plates of the bracket means 40 for communicating with the orifice 36 of the socket means 30, a first positioning rod 43 extending through the orifice 36 and slidably engaged in the vertical slot 42, two oblique slots 44 arranged in a V-shaped fashion being defined in each of the two side plates of the bracket means 40 and being symmetrical relative to the vertical slot 42 for communicating with the two horizontal slots 37, a pair of second positioning rods 45 each slidably extending through a respective oblique slot 44 and associated horizontal slot 37.

Figure 3:
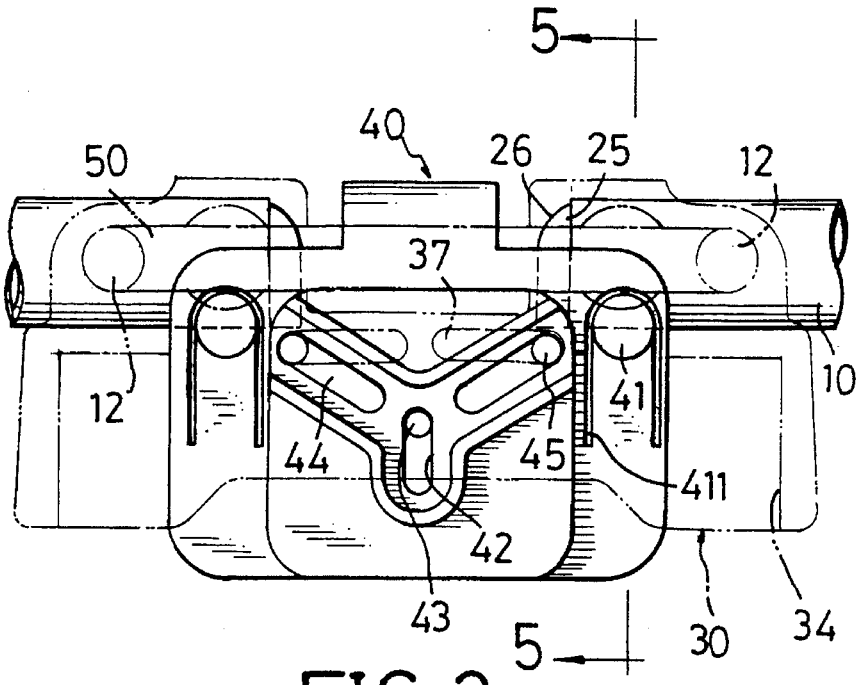
FIGS. 3 and 4 are operation views of the control device.
Figure 4:
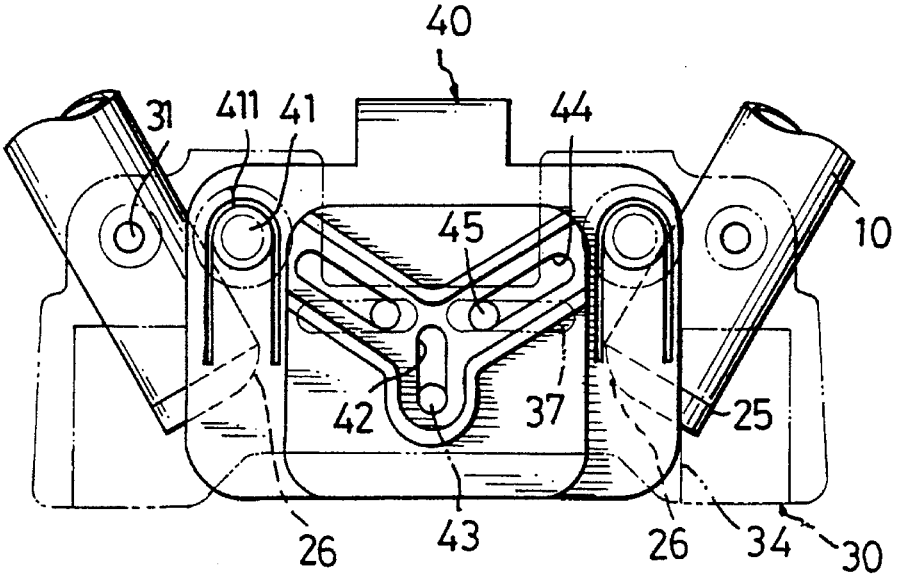

In operation, referring to FIGS. 3 and 4, the armrail 10 together with the coupling means 20 is initially fixed to the distal end of the socket means 30, the bracket means 40 is able to vertically slide up and down along the vertical slot 42 and is initially at a first location where the first positioning rod 43 abuts against a top face of the vertical slot 42 while the second positioning rods 45 each abut against a top face of each of the oblique slots 44 and against an outermost face of each of the horizontal slots 37 so as to bias against an underside of the shoulder 25 such that the armrail 10 together with the coupling means 20 is securely fixed to the distal end of the socket means 30 by means of the second positioning rod 45 even if the projection 241 of the stub 24 is detached from the first hole 33 (see FIG. 3). Then the bracket means 40 is moved upwardly to a second location where the first positioning rod 43 abuts against a bottom face of the vertical slot 42 while the second positioning rods 45 each abut against a bottom face of each of the oblique slots 44 and against an innermost face of each of the horizontal slots 37 such that the armrail 10 together with the coupling means 30 is able to rotate freely about the pin 12 when released from the distal end of the socket means 30 (see FIG. 4).

Figure 5:
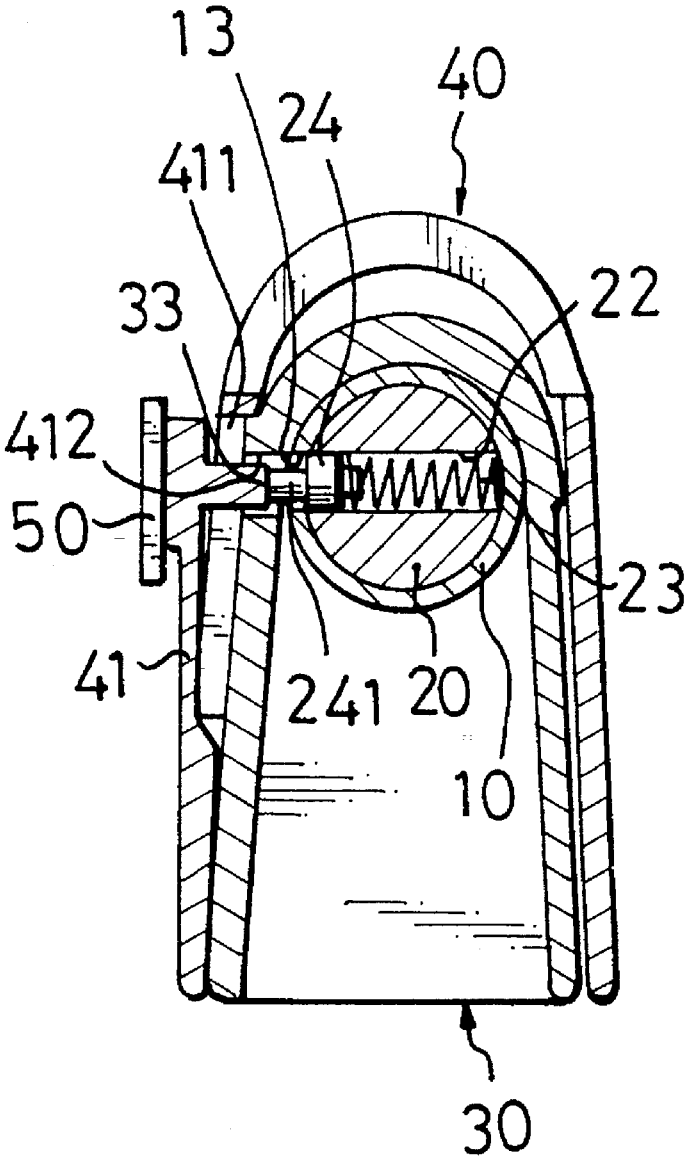
FIG. 5 is a cross-sectional view showing how a resilient member co-operates with a projection.
Figure 6:
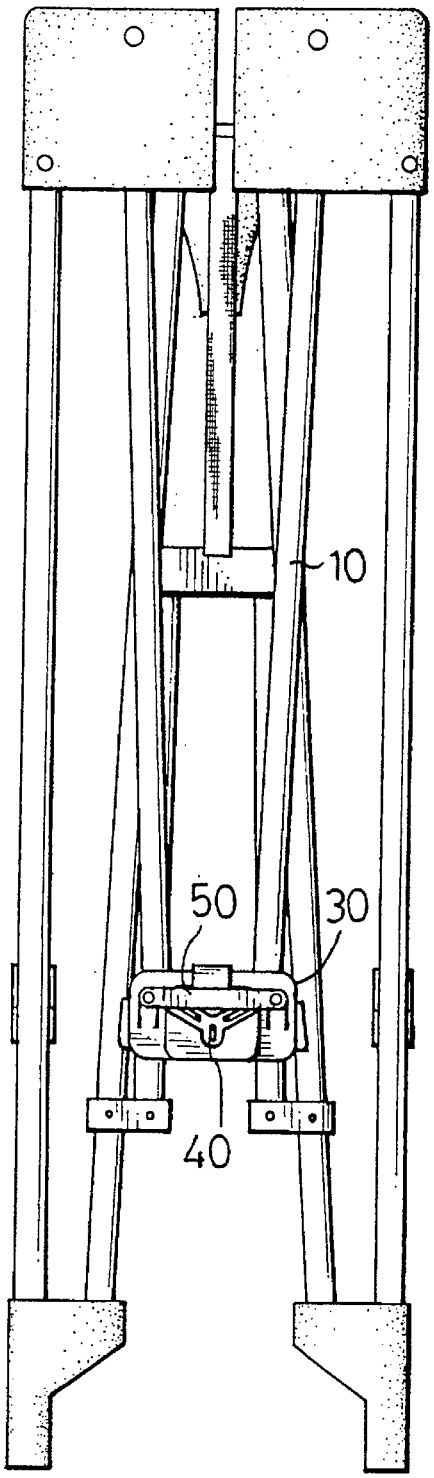
FIG. 6 is front plan view showing the playpen in a folding status.

Referring to FIGS. 2 and 5, the bracket means 40 further comprises a pair of resilient members 41 formed on the front side plate thereof, each of which defines a slit 411 in a peripheral portion thereof and has a lug portion 412 protruding inwards of the socket means 30 capable of biasing against the projection 241 of the stub 24 through the first hole 33 of the socket means 30 (see FIG. 5) when the bracket means 40 is at the second location so as to detach the projection 241 from the socket means 30 such that the armrail 10 is released from the distal end of the socket means 30 and is pivotally engaged with the socket means 30. A pressing member 50 is engaged with the pair of resilient members 41 for operating the pair of resilient members 41 synchronously. It is to be noted that when the bracket means 40 is not at the second location, the lug portion 412 of the resilient member 41 is not able to contact with the projection 241 of the stub 24 so as to provide a security function even if the pressing member 50 is unintentionally compressed. FIG. 6 shows the playpen is in a folded status.

Accordingly, by such an arrangement, a control device in accordance with the present invention has the following advantages and benefits:

(1) The playpen is easily folded just by depressing the pressing member to actuate the resilient members to detach the projection of the stub from the socket means and is easily expanded just by pulling the socket means upwardly to lock the projection into the fist hole of the socket means.

(2) The armrail is securely fixed to the distal end of the socket means by means of the second positioning rod even if the projection of the stub is detached from the first hole of the socket means so as to provide a further fixation function for the armrail.

(3) The bracket means can provide a security function even if the pressing member is unintentionally compressed.

It should be clear to those skilled in the art that further embodiments of the present invention may be made without departing from the teachings of the present invention.

I claim:

1. A control device for folding and expanding armrails of a playpen which comprises four pairs of armrails respectively arranged on four upper sides thereof, said control device cooperating with each pair of armrails and comprising:

socket means having two distal ends each pivotally engaged with a corresponding one of said pair of armrails, said socket means having a substantiality U-shaped configuration with two parallel side plates each having two distal ends, a longitudinal passage defined in said socket means between the two side plates thereof, a first hole defined in each of the two distal ends of one side plate of said socket means, a second hole defined in each of said pair of armrails and in alignment with an associated first hole, two horizontal slots defined in each of the two side plates of said socket means and located adjacent to each other, an orifice defined in each of the two side plates of said socket means and located under said two horizontal slots;

coupling means received in each of said pair of armrails and comprising a biasing member detachably engaged with a corresponding one of the two distal ends of said socket means, a shoulder formed on said coupling means and received in said passage and located above a corresponding one of said two horizontal slots, a tapered surface formed on said shoulder, a compartment defined in said coupling means and in alignment with said second hole of an associated armrail, said biasing member including a spring mounted in said compartment and a stub biased against said spring and having a projection extending through said second hole of said armrail and projecting outward of said first hole of said socket means, thereby fixing said armrail to an associated distal end of said socket means, wherein, when said projection of said stub is detached from said first hole of said socket means, said armrail together with said coupling means is released from an associated distal end of said socket means and is pivoted relative to said socket means; and bracket means having a substantially U-shaped configuration with two parallel side plates for covering said socket means, a vertical slot defined in each of said two side plates of said bracket means and communicating with an associated orifice, a first positioning rod extending through said two orifices and slidably received in said two vertical slots, two oblique slots arranged in a V-shaped fashion defined in each of the two side plates of said bracket means and arranged symmetrically relative to an associated vertical slot and communicating with said two horizontal slots, two second positioning rods each slidably extending through a corresponding one of said two oblique slots and a corresponding one of said two horizontal slots, wherein, said bracket means is vertically slidable between a first position where said first positioning rod abuts against a top face of said vertical slot while each of said two second positioning rods abuts against a top face of each of said two oblique slots and against an outermost face of each of said two horizontal slots so as to bias against an underside of said shoulder of said coupling means, such that each of said armrails together with an associated coupling means is fixed to an associated distal end of said socket means, and a second position where said first positioning rod abuts against a bottom face of said vertical slot while each of said to second positioning rods abuts against a bottom face of each of said two oblique slots and against an inner most face of each of said two horizontal slots, such that each of said armrails together with an associated coupling means is able to rotate freely.

2. The control device in accordance with claim 1, wherein said bracket means further comprises a pair of resilient members each having a lug portion formed thereon capable of biasing against said projection of said stub of an associated coupling means through an associated first hole of said socket means when said bracket means is at the second position such that each of said armrails is released from and pivotally engaged with an associated distal end of said socket means.

3. The control device in accordance with claim 2, further comprising a pressing member engaged with each of said pair of resilient members for operating each of said pair of resilient members synchronously.

* * * * *